United States Patent [19]

Chester et al.

[11] Patent Number: 4,605,488

[45] **Date of Patent: * Aug. 12, 1986**

[54] CATALYTIC DEWAXING OF LIGHT AND HEAVY OILS IN DUAL PARALLEL REACTORS

[75] Inventors: Arthur W. Chester, Cherry Hill; William E. Garwood, Haddonfield, both of N.J.; James C. Vartuli, West Chester, Pa.

[73] Assignee: Mobil Oil Corporation, New York, N.Y.

[ * ] Notice: The portion of the term of this patent subsequent to Aug. 12, 2003 has been disclaimed.

[21] Appl. No.: 733,339

[22] Filed: May 13, 1985

Related U.S. Application Data

[63] Continuation-in-part of Ser. No. 606,495, May 3, 1984.

[51] Int. Cl.[4] ..... C10G 65/18; C10G 65/12; C10G 67/02

[52] U.S. Cl. ..... 208/78; 208/97; 208/111; 208/120

[58] Field of Search ..... 208/78, 97, 111

[56] References Cited

U.S. PATENT DOCUMENTS

| | | | |
|---|---|---|---|
| 4,222,855 | 9/1980 | Pelrine et al. | 208/111 |
| 4,229,282 | 10/1980 | Peters et al. | 208/111 |
| 4,292,166 | 9/1981 | Gorring et al. | 208/59 |
| 4,372,839 | 2/1983 | Oleck et al. | 208/59 |
| 4,388,177 | 6/1983 | Bowes et al. | 208/138 |
| 4,414,097 | 11/1983 | Chester et al. | 208/18 |

*Primary Examiner*—Andrew H. Metz
*Assistant Examiner*—O. Chaudhuri
*Attorney, Agent, or Firm*—Alexander J. McKillop; Michael G. Gilman; Dennis P. Santini

[57] ABSTRACT

Relatively heavy and relatively light lube chargestocks are dewaxed in two parallel, separate reactors. The reactor used for dewaxing the relatively light chargestock contains a crystallize zeolite having pore openings defined by: (1) a ratio of sorption of n-hexane to o-xylene, on a volume percent basis, of greater than 3, which sorption is determined at a $P/P_o$ of 0.1 and at a temperature of 50° C. for n-hexane and 80° C. for o-xylene and (2) by the ability of selectively cracking 3-methylpentane (3MP) in preference to the doubly branched 2,3-dimethylbutane (DMB) at 1000° F. and 1 atmosphere pressure from a 1/1/1 weight ratio mixture of n-hexane/3-methyl-pentane/2,3-dimethylbutane, with the ratio of rate constants $k_{3MP}/k_{DMB}$ determined at a temperature of 1000° F. being in excess of about 2, e.g., natural and synthetic ferrierite, ZSM-22, ZSM-23, ZSM-35 and mixtures thereof. The reactor used for dewaxing the relatively heavy chargestock contains a crystalline aluminosilicate zeolite having pore openings defined by: (1) a ratio of sorption of n-hexane to o-xylene, on a volume percent basis, or less than 3, which sorption is determined at a $P/P_o$ of 0.1 and at a temperature of 50° C. for n-hexane and 80° C. for o-xylene, (2) the abiilty of selectively cracking 3-methylpentane (3MP) in preference to the doubly branched 2,3-dimethylbutane (DMB) at 1000° F. and 1 atmosphere pressure from a 1/1/1 weight ratio mixture of n-hexane/3-methyl-pentane/2,3-dimethylbutane, with the ratio of rate constants $k_{3MP}/K_{DMB}$ determined at a temperature of 1000° F. being less than about 2, and (3) a Constraint Index value of greater than about 1, e.g., ZSM-5, ZSM-11, ZSM-5/ZSM-11 intermediate and mixtures thereof.

16 Claims, 3 Drawing Figures

CATALYTIC DEWAXING OF LIGHT AND HEAVY OILS IN DUAL PARALLEL REACTORS

CROSS REFERENCE TO RELATED APPLICATION

This is a continuation-in-part of application Ser. No. 606,495, filed May 3, 1984.

BACKGROUND OF THE INVENTION

1. Field of the Invention

This invention relates to a novel process or dewaxing light and heavy oils in two parallel reactors, each containing a different porous crystalline catalyst.

2. Description of the Related Art

It is known to treat gas oil fractions, i.e., petroleum fractions having an initial boiling point of at least about 330° F., so as to selectively remove paraffinic hydrocarbons therefrom. This technique is desirable to order to permit many of these fractions to meet a pour point standard. In particular, many light gas oil fractions, that is, those which are used for No. 2 fuel (home heating oil) and/or Diesel fuel, have pour points which are too high to permit their intended use. A typical pour point specification is 0° F., whereas it is not uncommon for such gas oil fractions to have untreated pour points of 50° F. or higher.

Refining suitable petroleum crude oils to obtain a variety of lubricating oils which function effectively in diverse environments has become a highly developed and complex art. Although the broad principles involved in refining are qualitatively understood, the art is encumbered by quantitative uncertainties which require considerable resort to empiricism in practical refining. Underlying these quantitative uncertainties is the complexity of the molecular composition of lubricating oils. Because lubricating oils for the most part are based on petroleum fractions boiling above about 230° C. (450° F.), the molecular weight of the hydrocarbon constituents of the lubricating oils is high and these constituents display almost all conceivable structures and structural types. This complexity and its consequences are fully discussed in "Petroleum Refinery Engineering", by W. L. Nelson, McGraw Hill Book Company, Inc., New York, N.Y., 1958 (Fourth Edition), relevant portions of this text being incorporated herein by reference for background.

In general, the basic notion in lubricant refining is that a suitable crude oil, as shown by experience or by assay, contains a quantity of lubricant stock having a predetermined set of properties, such as, for example, appropriate viscosity, oxidation stability, and maintenance of fluidity at low temperatures. The process of refining to isolate that lubricant stock consists of a number of subtractive unit operations which remove the unwanted components. The most important of these unit operations include distillation, solvent refining, and dewaxing, which basically are physical separation processes in the sense that if all the separated fractions were recombined, the initial crude oil would be reconstituted.

Unfortunately, crude oils suitable for the manufacture of lubes are becoming less available due to the constant depletion of reserves. In addition, the reliability of a steady, adequate supply from a known source is also a matter of concern.

The desirability of upgrading a crude oil fraction normally considered unsuitable for lubricant manufacture to one from which good yields of lubes can be obtained has long been recognized. The so-called "hydrocracking process", sometimes referred to in the art as "severe hydrotreating", has been proposed to accomplish such upgrading. In this process a suitable fraction of a poor grade crude, such as a California crude, is catalytically reacted with hydrogen under pressure. The process is complex in that some of the oil is reduced in molecular weight and made unsuitable for lubes, but concurrently a substantial fraction of the polynuclear aromatics is hydrogenated to form naphthenes and paraffins. Process conditions and choice of catalyst are selected to provide an optimal conversion of the polynuclear aromatic content of the stock, since this component degrades the viscosity index and stability of the stock. Also, in the hydrocracking process, paraffins can be isomerized, imparting good viscosity index characteristics to the final lube product. A hydrocracking process for upgrading crude oil fractions and for dewaxing the hydrocrackate over ZSM-23 zeolite is disclosed in U.S. Pat. No. 4,414,097, the entire contents of which are incorporated herein by reference. Another upgrading process of oil stocks involves solvent refining thereof to extract out undesirable high molecular weight polynuclear aromatic compounds and nitrogen compounds.

Hydrocracked lube stocks and solvent refined stocks, such as, for example, light neutral furfural raffinate, however, tend to be unstable in the presence of air when exposed to sunlight. On such exposure, a sludge is formed, sometimes very rapidly and in substantial amounts. This tendency in a lubricating oil is unacceptable. Additionally, some hydrocracked lube oils tend to darken or to form a haze.

Several methods have been proposed to correct the above-described instability. U.S. Pat. No. 4,031,016 proposes to add certain antioxidants to the hydrocracked oil. A second proposed approach is to hydrotreat a hydrocrackate. Variants of this approach are described in U.S. Pat. No. 3,666,657, which teaches a sulfided mixture of an iron group metal and a Group VI metal for a subsequent hydrotreating stage; in U.S. Pat. No. 3,530,061 which utilizes a hydrotreating catalyst having one or more elements from Group IIB, VIB and VIII of the Periodic Table of Elements at hydrogen pressure up to about 100 psig; and in U.S. Pat. No. 4,162,962 which teaches hydrotreating a hydrocrackate at a temperature in the 200° C. to 300° C. range with a catalyst of prescribed pore size. U.S. Pat. No. 3,530,061 teaches a non-cracking support for a subsequent hydrotreating stage. U.S. Pat. No. 3,852,207 teaches the hydrotreating of oils with a noble metal hydrogenation component supported on an oxide. The patents cited above are believed representative of the state of the art, and each is incorporated herein by reference.

Hydrocracked and solvent refined lubricating oils generally have an unacceptably high pour point and require dewaxing. Solvent dewaxing is a well-known and effective process, but it is expensive. More recently catalytic methods for dewaxing have been proposed. U.S. Pat. No. Re. 28,398, the entire contents of which are incorporated herein by reference, describes a catalytic dewaxing process wherein a particular crystalline zeolite is used. To obtain lubricants and specialty oils with outstanding resistance to oxidation, it is often necessary to hydrotreat the oil after catalytic dewaxing, as illustrated by the teachings of U.S. Pat. No. 4,137,148. U.S. Pat. Nos. 4,283,271 and 4,283,272 teach continuous processes for producing dewaxed lubricating oil base stock including hydrocracking a hydrocarbon feedstock, catalytically dewaxing the hydrocrackate and hydrotreating the dewaxed hydrocrackate. Both of the latter patents teach the use of a catalyst comprising zeolite ZSM-5 or ZSM-11 for the dewaxing phase. U.S. Pat. No. 4,259,174 teaches the dewaxing of a lubricating oil stock having certain characteristics over a catalyst comprising synthetic offretite. U.S. Pat. Nos. 4,222,855 and 4,372,839, the contents of which are incorporated herein by reference, teach catalytic dewaxing processes for waxy hydrocarbon feedstocks over various catalysts exhibiting specified properties, including a catalyst comprising zeolite ZSM-23.

It is inferentially evident from the foregoing background material that the manufacture of modern high quality lubricants in general requires that the crude be treated in a sequence of fairly complex and costly steps. It is further evident that there is a need for processes which can efficiently provide such lubricants from interchangeable and readily available low grade crudes.

It is an object of the present invention to provide an improved process for catalytically dewaxing two different grades of previously-refined oil chargestocks: a relatively light petroleum chargestock and a relatively heavy petroleum chargestock, in a single, integrated process.

It is a further object of the invention to provide a method for manufacturing lubricating oils having a low pour point and good resistance to light.

These and other objects will become apparent to those skilled in the art from the study of the following specification and appended claims.

SUMMARY OF THE INVENTION

This invention provides an energy-efficient process for dewaxing solvent-refined or hydrocracked oils and, therefore, for manufacturing a stabilized and dewaxed lubricating oil stock from hydrocarbon feedstock.

The process comprises passing relatively light petroleum chargestocks, characterized by 50% boiling point of less than about 850° F., and kinematic viscosity at 100° C. of less than about 9 centistokes, through a first dewaxing reactor means containing a crystalline aluminosilicate zeolite having pore openings defined by: (1) a ratio of sorption of n-hexane to o-xylene, on a volume percent basis, of greater than about 3, which sorption is determined at a $P/P_o$ of 0.1 and at a temperature of 50° C. for n-hexane and 80° C. for o-xylene and (2) by the ability of selectively cracking 3-methylpentane (3MP) in preference to the doubly branched 2,3-dimethylbutane (DMB) at 1000° F. and 1 atmosphere pressure from a 1/1/1 weight ratio mixture of n-hexane/3-methyl-pentane/2,3-dimethylbutane, with the ratio of rate constants $k_{3MP}/k_{DMB}$ determined at a temperature of 1000° F. being in excess of about 2. Suitable zeolites used in the first reactor means are exemplified by natural and synthetic ferrierites, ZSM-22, ZSM-23 and ZSM-35 zeolites and/or mixtures thereof.

Alternatively or simultaneously, relatively heavy petroleum chargestocks, characterized by 50% boiling point of greater than about 850° F., and kinematic viscosity at 100° C. of greater than about 9 centistokes are passed through a second dewaxing reactor means containing a crystalline aluminosilicate zeolite having pore openings defined by: (1) a ratio of sorption of n-hexane to o-xylene, on a volume percent basis, of less than about 3, which sorption is determined at a $P/P_o$ of 0.1 and at a temperature of 50° C. for n-hexane and 80° C. for o-xylene; (2) the ability of selectively cracking 3-methylpentane (3MP) in preference to the doubly branched 2,3-dimethylbutane (DMB) at 1000° F. and 1 atmosphere pressure from a 1/1/1 weight ratio mixture of n-hexane/3-methyl-pentane/2,3-dimethylbutane, with the ratio of rate constants $k_{3MP}/k_{DMB}$ determined at a temperature of 1000° F. being less than about 2; and, (3) a Constraint Index value, defined below, of greater than about 1. Suitable zeolites used in the second reactor means are exemplified by ZSM-5, ZSM-11, ZSM-5/ZSM-11 intermediate and/or mixtures thereof.

The expression, "$P/P_o$", as utilized in the specification and the claims, is accorded its usual significance as described in the literature, for example, in "The Dynamical Character of Adsorption" by J. H. deBoer, 2nd Edition, Oxford University Press (1968) and is the relative pressure defined as the ratio of the partial pressure of sorbate to the vapor pressure of sorbate at the temperature of sorption. The ratio of the rate constants, $k_{3MP}/k_{DMB}$, is determined from 1st order kinetics, in the usual manner, by the following equation:

$$k=(1/T_c)\ln(1/1-\epsilon)$$

where k is the rate constant for each component, $T_c$ is the contact time and $\epsilon$ is the fractional conversion of each component.

The first and the second dewaxing reactor means may be operated simultaneously or in an alternative fashion. When operation is in alternative fashion, the first dewaxing reactor means is used to dewax the relatively light petroleum chargestock, the second reactor dewaxing means is idled or the zeolite catalyst in the second dewaxing reactor means is regenerated. Conversely, when the second dewaxing reactor means is used to dewax the relatively heavy chargestock, the first reactor dewaxing means is idled or the zeolite catalyst in the first dewaxing reactor means is regenerated. The effluent of the reactor in operation is passed into a common hydrotreating reactor, and a dewaxed lubricating stock is recovered from the hydrotreating reactor. When operation is simultaneous, a fractionator upstream of the dewaxing reactors will produce a split between relatively light and relatively heavy petroleum chargestocks, the light and heavy chargestocks will go to their respective dewaxing reactor, and the dewaxed stocks from each reactor will be passed to the hydrotreating reactor, etc.

The two types of crystalline aluminosilicate zeolites defined above have unexpectedly been found to possess different selectivity characteristics for dewaxing of the relatively light and the relatively heavy chargestocks, respectively: the zeolites of the first type (having such pore openings that their ratio of sorption of n-hexane to o-xylene is greater than about 3 and the $k_{3MP}/k_{DMB}$ ratio is greater than about 2) readily dewax relatively light petroleum chargestocks to produce lubestocks having higher viscosity at a given pour point than the zeolites of the second type (having pore openings defined by: (1) the ratio of sorption of n-hexane to o-xylene of less than about 3; (2) the ratio $k_{3MP}/k_{MDB}$ of less than about 2; and (3) Constraint Index of greater than about 1). Conversely, the zeolites of the second type readily decrease the pour point of the relatively heavy chargestocks to the desired target point of 10°–20° F., while the zeolites of the first type are less effective in reducing the pour point of the relatively heavy chargestocks.

DETAILED DESCRIPTION OF THE INVENTION

Figure 1:
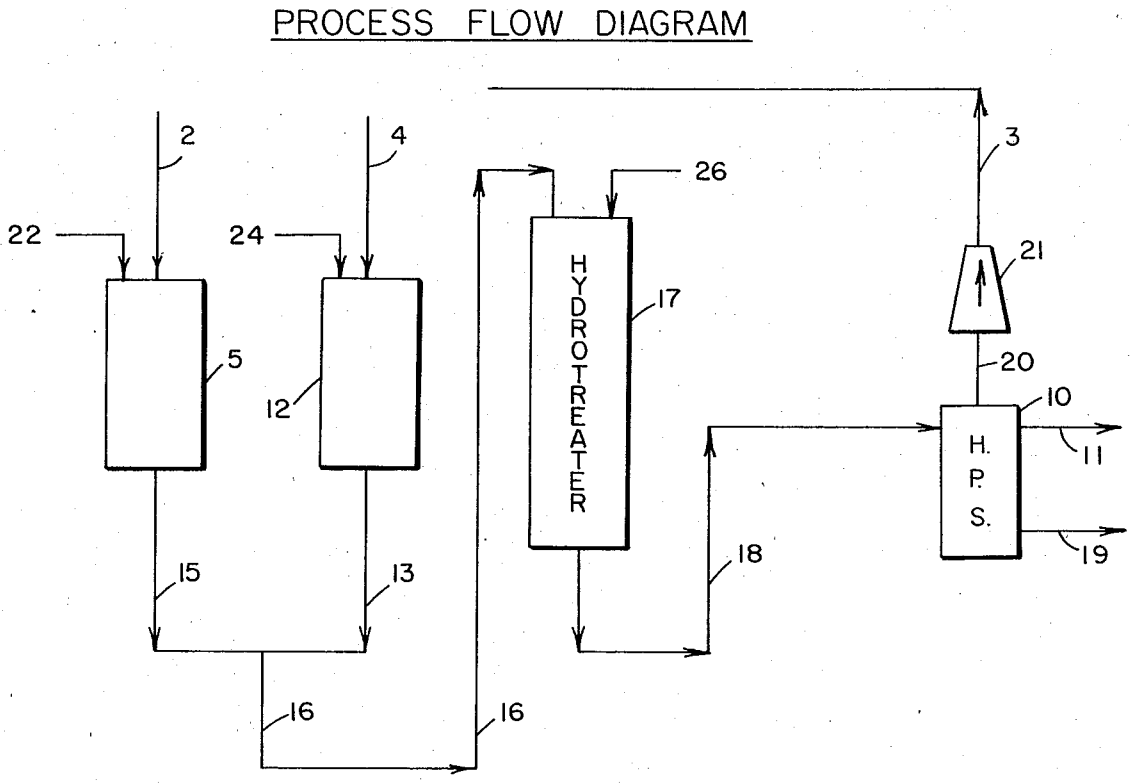
FIG. 1 is a schematic representation of a process of the present invention.

The relatively light petroleum chargestock may be obtained from distillation of crudes, and solvent extraction and/or hydrocracking of light distillate cuts, and it is exemplified by light neutrals, transformer oils, refrigerator oils, and specialty oils such as spray oils.

The relatively heavy petroleum chargestock may be obtained from distillation of crudes, and solvent extraction and/or hydrocracking of heavy distillate cuts and residua, and is is exemplified by heavy neutrals, and residual propane deasphalted (PD) raffinates.

Both the relatively light and the relatively heavy chargestocks are processed either through the conventional furfural extraction or the hydrocracking process steps prior to their introduction to one of the two dual reactors of the present invention. It is known in the art that the furfural extraction and the hydrocracking steps remove undesired aromatic and heterocyclic components from the chargestock. If the chargestock is processed through the furfural extraction step prior to the introduction thereof into the present process, the furfural raffinate stream comprises the feedstock of the process of the present invention. If the chargestock is processed through the hydrocracking step prior to the introduction thereof to the present process, the effluent of the hydrocracking step, also known as hydrocrackate, comprises the feedstock of the process of the present invention.

The relatively light chargestock is conducted to a first fixed bed catalytic reactor containing a crystalline aluminosilicate zeolite having pore openings defined by: (1) a ratio of sorption of n-hexane to o-xylene, on a volume percent basis, of greater than 3, which sorption is determined at a $P/P_o$ of 0.1 and at a temperature of 50° C. for n-hexane and 80° C. for o-xylene and (2) by the ability of selectively cracking 3-methylpentane (3MP) in preference to the doubly branched 2,3-dimethylbutane (DMB) at 1000° F. and 1 atmosphere pressure from a 1/1/1 weight ratio mixture of n-hexane/3-methyl-pentane/2,3-dimethylbutane, with the ratio of rate constants $k_{3MP}/k_{DMB}$ determined at a temperature of 1000° F. being in excess of about 2. Suitable zeolites used in the first reactor means are exemplified by ferrierite, ZSM-22, ZSM-23 and ZSM-35 and/or mixtures thereof. The quantities $P/P_0$ and $k_{3MP}/k_{DMB}$ are defined above.

Ferrierite is a naturally-occurring mineral, described in the literature, see, e.g., D. W. Breck, ZEOLITE MOLECULAR SIEVES, John Wiley and Sons (1974), pages 125–127, 146, 219 and 625, the entire contents of which are incorporated herein by reference.

ZSM-22 is a highly siliceous zeolite which can be prepared from a reaction mixture comprising a source of silica, an alkane diamine, an alkali metal oxide or an alkaline earth metal oxide, e.g., sodium, potassium, cesium, calcium or strontium, water, and alumina, and having a composition, in terms of mole ratios of oxides, falling within the following ratios:

| Reactants | | Broad | Preferred | Most Preferred |
|---|---|---|---|---|
| $SiO_2/Al_2O_3$ | = | 20 to ∞ | 30 to 1000 | 60 to 200 |
| $H_2O/SiO_2$ | = | 10 to 100 | 20 to 60 | 20 to 60 |
| $OH^-/SiO_2$ | = | 0 to 0.3 | 0.1 to 0.2 | 0.1 to 0.2 |
| $M^+/SiO_2$ | = | 0 to 2.0 | 0.1 to 1.0 | 0.1 to 1.0 |
| $RN/SiO_2$ | = | 0.01 to 2.0 | 0.05 to 1.0 | 0.05 to 1.0 |

wherein RN is a $C_2$–$C_{12}$ alkane diamine of the formula $H_2N—(CH_2)_n—NH_2$ (abbreviated $C_nDN$), n=2 to 12, and preferably is 5 to 8, and M is an alkali metal or an alkaline earth metal and maintaining the mixture at crystallization temperature until crystals of the ZSM-22 zeolite are formed. Thereafter, the crystals are separated from the liquid by any conventional means, washed and recovered.

Crystallization can be carried out at either static or stirred conditions in a reactor vessel, e.g., a polypropylene jar, teflon lined or stainless steel autoclaves, at 80° C. (176° F.) to about 210° C. (410° F.) for about 6 hours to 150 days. Thereafter, the crystals are separated from the liquid and recovered. The composition can be prepared utilizing materials which supply the appropriate oxide. Such materials include aluminates, alumina, silicates, sodium silicate, silica hydrosol, silica gel, silicic acid, sodium, potassium or cesium hydroxide, and an alkane diamine. Suitable diamines are, e.g., ethanediamine, propanediamine, butanediamine, pentanediamine, hexanediamine, heptanediamine, octane-diamine, nonanediamine, decanediamine, undecanediamine, duodecane-diamine. The reaction mixture can be prepared either batchwise or continuously. Crystal size and crystallization time of the crystalline material varies with the nature of the reaction mixture employed and the crystallization conditions.

As set forth above, the ZSM-22 zeolite can be prepared at a relatively wide range of $SiO_2/Al_2O_3$ ratios of from about 20 to as near infinity as practically possible. However, it has been found that larger alkali metal cations, e.g., $K^+$ and $Cs^+$, are preferably used at the $SiO_2/Al_2O_3$ ratios of about 20 to about 90 to obtain ZSM-22 crystals substantially free of impurities or other zeolites. The potassium ($K^+$) cation is preferred at such low $SiO_2/Al_2O_3$ ratios because cesium (Cs) appears to decrease the reaction rate. At the $SiO_2/Al_2O_3$ ratios of 90 or above, e.g., 90 to 200, smaller cations, e.g., sodium ($Na^+$) cations, are preferably used to produce substantially 100% crystalline ZSM-22.

The highly siliceous ZSM-22 zeolite comprises crystalline, three-dimensional continuous framework silicon-containing structures or crystals which result when all the oxygen atoms in the tetrahedra are mutually shared between tetrahedral atoms of silicon or aluminum, and which can exist with a network of mostly $SiO_2$, i.e., exclusive of any intracrystalline cations. In the as-synthesized form, the ZSM-22 has a calculated composition, in terms of moles of oxides, after dehydration, per 100 moles of silica, as follows:

$$(0.02 \text{ to } 10)RN:(0 \text{ to } 2)M_{2/n}O:(0 \text{ to } 5)Al_2O_3:100SiO_2$$

wherein RN is a $C_2$–$C_{12}$ alkane diamine and M is an alkali metal or an alkaline earth metal having a valence n, e.g., Na, K, Cs, Li, Ca or Sr.

ZSM-22 can further be identified by its sorptive characteristics and its X-ray diffraction pattern. The original cations of the as-synthesized ZSM-22 may be replaced at least in part by other ions using conventional ion exchange techniques. It may be necessary to precalcine the ZSM-22 zeolite crystals prior to ion exchange. The replacing ions introduced to replace the original alkali, alkaline earth and/or organic cations may be any ions that are desired so long as they can pass through the channels within the zeolite crystals. Desired replacing ions are those of hydrogen, rare earth metals, metals of Groups IB, IIA, IIB, IIIA, IIIB, IVA, IVB, VIB and VIII of the Periodic Table. Among the metals, those particularly preferred are rare earth metals, manganese, zinc and those of Group VIII of the Periodic Table.

ZSM-22 zeolite described herein has a definite X-ray diffraction pattern, set forth below in Table A, which distinguishes it from other crystalline materials.

TABLE A

| Most Significant Lines of ZSM-22 | |
|---|---|
| Interplanar d-spacings Å | Relative Intensity |
| 10.9 ± 0.2 | M-VS |
| 8.7 ± 0.16 | W |
| 6.94 ± 0.10 | W-M |
| 5.40 ± 0.08 | W |
| 4.58 ± 0.07 | W |
| 4.36 ± 0.07 | VS |
| 3.68 ± 0.05 | VS |
| 3.62 ± 0.05 | S-VS |
| 3.47 ± 0.04 | M-S |
| 3.30 ± 0.04 | W |
| 2.74 ± 0.02 | W |
| 2.52 ± 0.02 | W |

These values were determined by standard techniques. The radiation was the K-alpha doublet of copper and a diffractometer equipped with a scintillation counter and an associated computer were used. The peak heights, I, and the positions as a function of 2 theta, where theta is the Bragg angle, were determined using algorithms on the computer associated with the spectrometer. From these, the relative intensities, 100 $I/I_o$, where $I_o$ is the intensity of the strongest line or peak, and d (obs.) the interplanar spacing in angstroms (Å), corresponding to the recorded lines, were determined. In Table I, the relative intensities are given in terms of the following symbols vs=very strong, s=strong, m=medium, w=weak, etc. It should be understood that this X-ray diffraction pattern is characteristic of all the species of ZSM-22 zeolite compositions. Ion exchange of the alkali or alkaline earth metal cations with other ions results in a zeolite which reveals substantially the same X-ray diffraction pattern as that of Table I with some minor shifts in interplanar spacing and variations in relative intensity. Other minor variations can occur, depending on the silica to alumina ratio of the particular sample, as well as its degree of thermal treatment.

The ZSM-22 zeolite freely sorbs normal hexane and has a pore dimension greater than about 4 Angstroms. In addition, the structure of the zeolite must provide constrained access to larger molecules. It is sometimes possible to judge from a known crystal structure whether such constrained access exists. For example, if the only pore windows in a crystal are formed by 8-membered rings of silicon and aluminum atoms, then access by molecules of larger cross-section than normal hexane is excluded and the zeolite is not of the desired type. Windows of 10-membered rings are preferred, although, in some instances, excessive puckering or pore blockage may render these zeolites ineffective. Twelve-membered rings do not generally appear to offer sufficient constraint to produce the advantageous hydrocarbon conversions, although puckered structures exist such as TMA offretite which is a known effective zeolite. Also, such twelve-membered structures can be conceived that may be operative due to pore blockage or other causes.

Rather than attempt to judge from crystal structure whether or not a zeolite possesses the necessary constrained access, a simple determination of the "constraint index" may be made by passing continuously a mixture of an equal weight of normal hexane and 3-methylpentane over a sample of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F. for at least 15 minutes. The zeolite is then flushed with helium and the temperature adjusted to between 550° F. (288° C.) and 950° F. (510° C.) to give an overall conversion between 10% and 60%. The mixture of hydrocarbons is passed at a 1 liquid hourly space velocity (LHSV), i.e., 1 volume of liquid hydrocarbon per volume of zeolite per hour, over the zeolite with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The "constraint index" is calculated as follows:

$$\text{Constraint Index} = \frac{\log_{10}(\text{fraction of n-hexane remaining})}{\log_{10}(\text{fraction of 3-methylpentane remaining})}$$

The constraint index approximates the ratio of the cracking rate constants for the two hydrocarbons. The ZSM-22 zeolite has a constraint index of about 7.3 at 800° F. (427° C.). Constraint Index (CI) values for some other typical zeolites are:

| Zeolite | C.I. |
|---|---|
| ZSM-5 | 6-8.3 |
| ZSM-11 | 6-8.7 |
| ZSM-12 | 2 |
| ZSM-23 | 9.1 |
| ZSM-38 | 2 |
| ZSM-35 | 4.5 |
| Clinoptilolite | 3.4 |
| TMA Offretite | 3.7 |
| Beta | 0.6-1.5 |
| ZSM-4 | 0.5 |
| H—Zeolon 0.4 | |
| REY | 0.4 |
| Amorphous Silica-Alumina (non-zeolite) | 0.6 |
| Erionite | 38 |

It is to be realized that the above constraint index values typically characterize the specified zeolites but that these are the cumulative result of several variables used in determination and calculation thereof. Thus, for a given zeolite depending on the temperature employed within the aforenoted range of 550° F. to 950° F., with accompanying conversion between 10% and 60%, the constraint index may vary within the indicated approximate range of 1 to 12. Likewise, other variables, such as the crystal size of the zeolite, the presence of possible occluded contaminants and binders intimately combined with the zeolite, may affect the constraint index. It will accordingly be understood by those skilled in the art that the constraint index, as utilized herein, while affording a highly useful means for characterizing the zeolites of interest is an approximation, taking into consideration the manner of its determination, with probability, in some instances, of compounding variable extremes.

While the above experimental procedure will enable one to achieve the desired overall conversion of 10 to 60% for most catalyst samples and represents preferred conditions, it may occasionally be necessary to use somewhat more severe conditions for samples of very low activity, such as those having a very high silica to alumina mole ratio. In those instances, a temperature of up to about 1000° F. and a liquid hourly space velocity of less than one, such as 0.1 or less, can be employed in order to achieve a minimum total conversion of about 10%.

The sorption of hydrocarbons by ZSM-22 has been surveyed and the results are summarized in Table B. Sorption capacities for n-hexane (normal hexane), cyclohexane, and water are about 4% by weight, or about one third that of ZSM-5. Cyclohexane and o-xylene sorption is relatively slow, making it difficult to determine equilibrium capacities.

TABLE B

ZSM-22 Sorption Data

| Sample | Form | Sorptions (wt %)[a] n-hexane | 3-methylpentane | Cyclohexane[c] | $H_2O$ | o-xylene[b] |
|---|---|---|---|---|---|---|
| 1 | Hydrogen | 3.9 | — | 2.8 | — | — |
| 2 | Hydrogen | 4.2 | 3.9 | 1.1 | — | 2 |
| 3 | Hydrogen | 4.1 | — | 3.3 | 4.7 | — |
| 4 | as-synthesized | 3.4 | — | — | — | — |

[a]Hydrocarbons: vapor pressure = 20 mm Hg, temperature = 25° C.; water-pressure = 12 mm Hg, temperature = 25° C.
[b]vapor pressure = 3.7 mm Hg, temperature = 120° C.
[c]slow tailing sorption, nonequilibrium values.

The n-hexane/o-xylene ratios may vary under different conditions, as illustrated by the data of Table C, below:

TABLE C

Additional Adsorption Properties of ZSM-22
Sample Temperature = 100° C.

| Sample | Form | Sorbate | Vapor Pressure (mm Hg) | $P/P_o$ | Wt % sorbed |
|---|---|---|---|---|---|
| 5 | Hydrogen | n-Hexane | 80 | 0.04 | 4.0 |
| 6 | Hydrogen | o-Xylene | 5 | 0.025 | 1.1 |

The ZSM-22 zeolite, as synthesized, tends to crystallize as agglomerates of elongated crystals having the size of about 0.5 to about 2.0 microns ($\mu$). Ballmilling fractures these crystals into smaller size crystallites (about 0.1$\mu$) without significant loss of crystallinity. The zeolite can be shaped into a wide variety of particle size. Generally speaking, the particles can be in the form of a powder, a granule, or a molded product, such as an extrudate having particle size sufficient to pass through a 2 mesh (Tyler) screen and be retained on a 400 mesh (Tyler) screen. In cases where the catalyst is molded, such as by extrusion, the crystals can be extruded before drying or partially dried and then extruded.

ZSM-23 is described in U.S. Pat. Nos. 4,076,842 and 4,104,151, the entire contents of both being incorporated herein by reference.

ZSM-35 is a synthetic analogue of ferrierite, and it is described in U.S. Pat. Nos. 4,016,245 and 4,107,195, the entire contents of which are incorporated herein by reference.

The relatively heavy chargestock is conducted to a second fixed catalytic reactor containing a crystalline aluminosilicate zeolite having pore openings defined by: (1) a ratio of sorption of n-hexane to o-xylene, on a volume percent basis, of less than about 3, which sorption is determined at a $P/P_o$ of 0.1 and at a temperature of 50° C. for n-hexane and 80° C. for o-xylene; and (2) the ability of selectively cracking 3-methylpentane (3MP) in preference to the doubly branched 2,3-dimethylbutane (DMB) at 1000° F. and 1 atmosphere pressure from a 1/1/1 weight ratio mixture of n-hexane/3-methyl-pentane/2,3-dimethylbutane, with the ratio of rate constants $k_{3MP}/k_{DMB}$ determined at a temperature of 1000° F. being less than about 2; and (3) a Constraint Index value of greater than about 1. The zeolite contained in the second reactor is exemplified by ZSM-5, ZSM-11, ZSM-5/ZSM-11 intermediate and/or mixtures thereof.

ZSM-5 having a silica:alumina ($SiO_2$:$Al_2O_3$) mole ratio of at least 5 is described in U.S. Pat. No. 3,702,886, the entire contents of which are incorporated herein by reference.

ZSM-5 having a $SiO_2$:$Al_2O_3$ mole ratio of at least 200 is described in U.S. Pat. No. Re. 29,948, the entire contents of which are incorporated herein by reference.

ZSM-11 is described in U.S. Pat. No. 3,709,979, the entire contents of which are incorporated herein by reference.

ZSM-5/ZSM-11 intermediate is described in U.S. Pat. No. 4,229,424, the entire contents of which are incorporated herein by reference.

The catalysts in the first and the second fixed bed catalytic reactors may be used without a metal component. In the preferred embodiment, however, the catalysts contain a metal hydrogenation component, i.e., about 0.05 to about 2% by weight of a metal, metal oxide or metal sulfide from Group VIIIA of the Periodic Chart of the Elements (published by the Fischer Scientific Company, Catalog Number 5-702-10) or a mixture thereof, alone or in combination with about 0.1% to about 10% by weight of one or more metal, metal oxide or metal sulfide from Group VIA of the Periodic Chart of the Elements. Examples of the metals from Group VIIIA are platinum, palladium, irridium, ruthenium, cobalt and nickel. Examples of the metals from Group VIA are chromium, molybdenum and tungsten. In the most preferred embodiment, ZSM-23 zeolite comprising about 0.05 to about 2.0% by weight of platinum is used in the first dewaxing catalytic reactor, and ZSM-5 zeolite comprising about 0.5 to about 5.0% by weight of nickel is used in the second dewaxing catalytic reactor. Both dewaxing reactors are operated at a temperature of about 400° F. to about 900° F., preferably about 550° F. to about 750° F., at pressure of about 50 to about 3000 psig, preferably about 500 to about 1500 psig, and at about 0.1 to about 10 liquid hourly space velocity (LHSV), preferably about 0.5 to about 2 LHSV, and, when hydrogen is used, 500 to 10,000 standard cubic feet of hydrogen per barrel of feed (SCF/B), preferably 1000 to 5000 SCF/B. The residence time of the chargestocks in the dewaxing reactors is such that the effluents of the reactors have a pour point of 20° F. or less.

The effluent from the first or the second catalytic dewaxing reactor is conducted to a common hydrotreating unit operated in the same broad range of conditions used in the two catalytic, dewaxing reactors, but preferably in the lower temperature ranges of about 400° to about 600° F. The hydrotreating unit contains a conventional hydrotreating catalyst, such as one or more metals from Group VIIIA (e.g., cobalt and nickel) and one or more metals from Group VIA (e.g., molybdenum and tungsten) of the Periodic Chart of the Elements, supported by an inorganic oxide, such as alumina or silica-alumina. Examples of some specific hydrotreating catalysts are cobalt-molybdate or nickel-molybdate on an alumina support.

The effluent from the hydrotreating unit is passed to a conventional separation section wherein light hydrocarbons and hydrogen are separated from the stabilized dewaxed lubricating oil stock.

The invention will now be described in connection with one exemplary embodiment thereof shown in FIG. 1.

The relatively light chargestock is introduced through a line 2 into a first reactor 5 containing a crystalline aluminosilicate zeolite of the first type, as described above, such as ferrierite, ZSM-22, ZSM-23 or ZSM-35 zeolite catalysts wherein the chargestock is subjected to dewaxing conditions. Alternately, a relatively heavy chargestock is conducted through a conduit 4 into a second reactor 12 containing a crystalline aluminosilicate zeolite of the second type, defined above, such as ZSM-5, ZSM-11 or ZSM-5/ZSM-11 intermediate zeolite catalysts, wherein it also is subjected to dewaxing conditions. The terms "ratio of sorption of n-hexane to o-xylene", "$k_{3MP}/k_{DMB}$" and "Constraint Index" are defined above.

The reactors 5 and 12 are operated in an alternative fashion, i.e., when the relatively light chargestock is dewaxed, reactor 5 is in the operating mode, while reactor 12 is either idled or it is in the regenerating mode (i.e., the catalyst in reactor 12 is regenerated). Conversely, when the relatively heavy chargestock is dewaxed, reactor 12 is in the operating mode, while reactor 5 is idled or it is in the regenerating mode. For the sake of simplicity, the operation of the process will be described herein with the reactor 5 in the operating mode and reactor 12 in the regenerating mode. However, it will be obvious to those skilled in the art that the process is operated analogouesly when the reactor 5 is in the regenerating mode and reactor 12 in the operating mode.

The effluent of the reactor 5 is conducted through a conduit 15 into a conduit 16 which passes the effluent to a common hydrotreater unit 17. The hydrotreater 17 contains a hydrotreating catalyst in a hydrotreating zone at stabilizing conditions. Examples of suitable hydrotreating catalysts include one or more metals from Group VIIIA and one or more metals from Group VIA of the Periodic Chart of the Elements, supported on a suitable catalyst support, e.g., alumina or silica-alumina, as defined above.

The effluent from the hydrotreater is passed through a line 18 to a high pressure separation section 10 (or high pressure separator), wherein it is treated to separate light hydrocarbons which are removed together with a hydrogen bleed through a line 11. Also recovered in the high pressure separator 10 is a hydrocarbon mixture comprising a stabilized and dewaxed lubricating oil stock, which is recovered through a line 19. The hydrocarbon mixture containing the lubricating oil stock is passed through line 19 to a separate unit, not shown in FIG. 1, for recovery of the lubricating oil stock. Hydrogen separated in section 10 is passed through a line 20 to a compressor 21 to raise its pressure, and it is then passed through a line 3 to an upstream processing unit, such as a hydrocracker unit, also not shown in FIG. 1. Optionally, fresh hydrogen and/or recycle hydrogen streams may be introduced into the reactors 5 and 12 through the conduits 22 and 24, respectively. If hydrogen is not introduced into the reactors 5 and 12, fresh or recycle hydrogen is introduced through a conduit 26 into the hydrotreater 17.

Although reactors 5 and 12 are described in relation to the drawing as operating in alternating fashion, it is possible to operate both reactors simultaneously as above described.

In this mode of operation, one or more fractionators, not shown, could be used to provide a relatively light chargestock to reactor 5 via line 2, and a relatively heavy chargestock via line 4 to reactor 12. Both reactors could operate at the same pressure, although it is not essential to do this. The reactor effluent may be mixed and passed directly to hydrotreater 17, or alternatively a vapor liquid separation means, not shown, may be used to provide a relatively heavy liquid stream which would be charged via line 16 to hydrotreater 17. Because the light and heavy fractions would be mixed together going through the hydrotreater, there must be a means provided downstream of the hydrotreater to separate these light and heavy fractions, assuming that such separation is desired. To accomplish this, conventional distillation columns may be provided downstream of the high pressure separator 10, which would fractionate the dewaxed and hydrotreated liquid removed from separator 10 via line 19 into light and heavy fractions.

Operating with reactors 5 and 12 both in service at the same time may require some additional capital and operating expense due to downstream fractionation, however, this will largely be offset by a savings in upstream fractionation costs. It is not critical to make a good split between light and heavy components upstream of reactors 5 and 12, because a relatively rough separation into light and heavy components will be enough. A better split between light and heavy components can be accomplished in downstream fractionation facilities.

The dewaxing catalysts used in reactors 5 and 12 may be incorporated with a matrix or binder component comprising a material resistant to the temperature and other process conditions.

Useful matrix materials include both synthetic and naturally occurring substances, as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee, Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the catalysts employed in reactors 5 and 12 may be composited with a porous matrix material, such as alumina, silica-alumina, silica-magnesia, silica-zirconia, silica-thoria, silica-beryllia, silica-titania as well as ternary compositions such as silica-alumina-thoria, silica-alumina-zirconia, silica-alumina-magnesia and silica-magnesia-ziconia. The matrix can be in the form of a cogel. The relative proportions of the catalyst component and inorganic oxide gel matrix on the anhydrous basis, may vary widely with the catalyst content ranging from between about 1 to about 99 percent by weight and more usually in the range of about 5 to about 80 percent by weight of the dry composite.

The above-defined hydrogenation component associated with the dewaxing catalyst may be on the zeolite component as above-noted or on the matrix component or both.

In order to more fully illustrate the nature of the present invention, the following non-limiting examples are presented.

EXAMPLE 1

Dewaxing of Heavy Neutral and Waxy Raffinate Over ZSM-23

There were two catalysts used in this example: ZSM-23 zeolite containing 0.3 and 1.7 wt.% platinum (Pt). The ZSM-23 zeolite was synthesized as described in U.S. Pat. No. 4,076,842 with pyrrolidine as the source of nitrogen containing cation. It was mixed with 35 wt.% alumina, extruded and impregnated with platinum ammine chloride so that the finished catalyst contained 0.3 wt.% and 1.7 wt% Pt, respectively.

Two charge stocks were used, a heavy neutral raffinate (from furfural extraction) and a waxy raffinate (from propane deasphalting of residuum followed by furfural extraction), having the following properties:

| | Heavy Neutral | Waxy Raffinate |
|---|---|---|
| Gravity, °API | 30.4 | 25.3 |
| Specific | 0.8740 | 0.9024 |
| Pour Point, °F. | >115 | >115 |
| (K.V. @ 100° C., cs) | 9.91 | 27.16 |
| Sulfur, wt. % | 0.80 | 1.24 |
| Nitrogen | 0.005 | 0.027 |
| Distillation, °F. | | |
| IBP | 678 | 875 |
| 5% | 851 | 919 |
| 10% | 870 | 940 |
| 30% | 885 | 996 |
| 50% | 908 | 1039 |
| 70% | 925 | 1089 |
| 90% | 950 | — |
| 95% | 960 | — |

These two chargestocks were passed over the two catalysts at 400 psig, 1 LHSV, and 2500 SCF $H_2$/barrel with the results summarized in Table II, below.

TABLE II

| Catalyst | Heavy Neutral 0.3% Pt/ZSM-23 | | Heavy Neutral 1.7% Pt/ZSM-23 | | | Waxy Raffinate 0.3% Pt/ZSM-23 | |
|---|---|---|---|---|---|---|---|
| Run No. | 1 | 2 | 3 | 4 | 5 | 6 | 7 |
| Cat. Temp., °F. | 600 | 653 | 551 | 600 | 651 | 650 | 701 |
| Mat. Bal. Time, Hrs. | 18 | 22½ | 16½ | 22½ | 22½ | 20 | 22½ |
| Time on stream, Days | 0.8 | 1.7 | 1.6 | 2.5 | 3.4 | 2.5 | 3.4 |
| Mat. Bal., wt. % | 99.5 | 100.3 | 100.1 | — | 99.8 | 100.5 | 101.5 |
| 650° F.+ Product | | | | | | | |
| Yield, wt. % | 91.0 | 87.8 | 96.2 | — | 86.7 | 92.9 | 96.1 |
| Gravity, °API | 28.7 | 28.5 | 28.7 | 28.5 | 29.9 | 28.3 | 26.6 |
| Pour Point, °F. | +45 | +50 | +85 | +45 | +50 | +60 | +75 |
| Kinematic viscosity | | | | | | | |
| K.V. @ 40° C., cs | 87.39 | 87.90 | 82.66 | 88.68 | 87.68 | 333.1 | 379.5 |
| K.V. @ 100° C., cs | 10.38 | 10.41 | 10.04 | 10.51 | 10.51 | 25.32 | 26.31 |
| Viscosity Index | 100.1 | 99.5 | 101.2 | 100.3 | 100.3 | 98.6 | 92.9 |

The results show that target pour point in the range of 10°–20° F. was not attained even at the dewaxing temperature of 650°–700° F.

EXAMPLE 2

Dewaxing of Heavy Neutral and Waxy Raffinate Over ZSM-5

Two chargestocks, having essentially the same properties as those used in Example I, were passed over a ZSM-5 zeolite. The ZSM-5 zeolite had a $SiO_2$:$Al_2O_3$ mole ratio of 70, it contained 1% by weight of nickel (Ni), was composited with 35% alumina binder, and was then steamed for about 6 hours at about 900° F. at atmospheric pressure. The chargestocks were contacted with the ZSM-5 zeolite at 400 psig, 2500 standard cubic feet of hydrogen per barrel (SCF $H_2$/barrel), with the following results:

| Run No. | Heavy Neutral 8 | 9 | 10 | Waxy Raffinate 11 | 12 |
|---|---|---|---|---|---|
| Liquid Hourly Space Velocity (LHSV) | 1.0 | 1.0 | 1.0 | 0.8 | 0.8 |
| Cat. Temp., °F. | 551 | 561 | 558 | 550 | 550 |
| Mat. Bal. Time, Hrs. | 18 | 22* | 22.5 | 20.5 | 23 |
| Time on stream, Days | 0.9 | 1.9 | 4.9 | 0.9 | 1.8 |
| Mat. Bal., wt. % | 94.4 | 96.0 | 96.4 | 98.8 | 100.7 |
| 650° F.+ Lube Product | | | | | |
| Yield, wt. % | 82.8 | 81.5 | 83.3 | 90.6 | 90.2 |
| Gravity, °API | 28.5 | 27.3 | 28.0 | 24.6 | 24.5 |
| Pour Point, °F. | +10 | +5 | +10 | 0 | +15 |
| K.V. @ 40° C., cs | 109.0 | 108.7 | 103.8 | 469.6 | 471.9 |
| K.V. @ 100° C., cs | 11.42 | 11.36 | 11.19 | 30.22 | 30.55 |
| Viscosity Index | 90.0 | 89.3 | 92.4 | 93.0 | 93.9 |

*At conclusion of material balance, 100 ppm n-methyl pyrrolidone was added to the chargestock.

This example shows that ZSM-5 zeolite readily hydrodewaxes these two heavy chargestocks, in contrast to ZSM-23 zeolite which, as Example 1 above illustrates, is not an effective dewaxing catalyst for heavy chargestocks.

EXAMPLE 3

Light Neutral Over ZSM-23

The chargestock in this example was a light neutral furfural raffinate, having the following properties.

| | |
|---|---|
| Gravity, °API | 32.1 |
| Specific | 0.8649 |
| Pour Point, °F. | +95 |

-continued

| | |
|---|---|
| K.V. @ 100° C., cs | 4.47 |
| Sulfur, wt. % | 0.70 |
| Nitrogen, wt. % | 0.003 |
| Distillation, °F. | |
| IBP | ~650 |
| 5% | 681 |
| 10% | 715 |
| 30% | 769 |
| 50% | 804 |
| 70% | 842 |
| 90% | 925 |
| 95% | 968 |

This stock was passed over the two Pt/ZSM-23 catalysts of Example 1 at 400 psig, 1 LHSV, and 2500 SCF $H_2$/bbl with the following results:

| Catalyst | 0.3% Pt/ZSM-23 | | 1.7% Pt/ZSM-23 | | |
|---|---|---|---|---|---|
| Run No. | 13 | 14 | 15 | 16 | 17 |
| Cat. Temp., °F. | 600 | 650 | 601 | 575 | 625 |
| Mat. Bal. Time, Hrs. | 22½ | 22½ | 20½ | 94 | 22½ |
| Time on stream, Days | 4.5 | 5.4 | 8.2 | 12.1 | 13.0 |
| Mat. Bal., wt. % | 102.0 | 97.3 | 100.3 | 100.3 | 101.2 |
| 650° F.+ Lube Product | | | | | |
| Yield, wt. % | 84.6 | 78.7 | 82.5 | 94.4 | 86.5 |
| Gravity, °API | 31.2 | 30.3 | 30.3 | 31.3 | 30.8 |
| Pour Point, °F. | +50 | +10 | −5 | +40 | +10 |
| K.V. @ 40° C., cs | 27.34 | 30.21 | 33.14 | — | 30.05 |
| K.V. @ 100° C., cs | 4.96 | 5.17 | 5.39 | 4.95 | 5.17 |
| Viscosity Index | 105.5 | 99.2 | 94.1 | — | 100.6 |

This example shows that the ZSM-23 zeolite readily hydrodewaxes the light neutral stock.

EXAMPLE 4

Dewaxing of Light Neutral Over ZSM-5

The chargestock of Example 3 was passed over a sample of the ZSM-5 zeolite identified in Example 2 catalyst at the same conditions as in Example 3 with the following results:

| Run No. | 18 | 19 |
|---|---|---|
| Cat. Temp., °F. | 550 | 576 |
| Mat. Bal. Time, Hrs. | 18 | 21 |
| Time on Stream, Days | 0.8 | 1.6 |
| Mat. Bal. wt. % | 99.4 | 99.7 |
| 610° F.+ Lube Product | | |
| Yield, wt. % | 82.3 | 76.0 |
| Gravity, °API | 30.0 | 28.9 |
| Pour Point, °F. | +40 | +15 |
| K.V. @ 40° C., cs | 29.59 | 32.93 |
| K.V. @ 100° C., cs | 5.12 | 5.34 |
| Viscosity Index | 100.4 | 92.1 |

This Example shows that ZSM-5 zeolite is unexpectedly much less selective as compared to ZSM-23 zeolite for hydrotreating the light neutral chargestock, since it produces a product oil of lower viscosity index (V.I.) at the same pour point and at a lower yield than the ZSM-23 zeolite.

Figure 2:
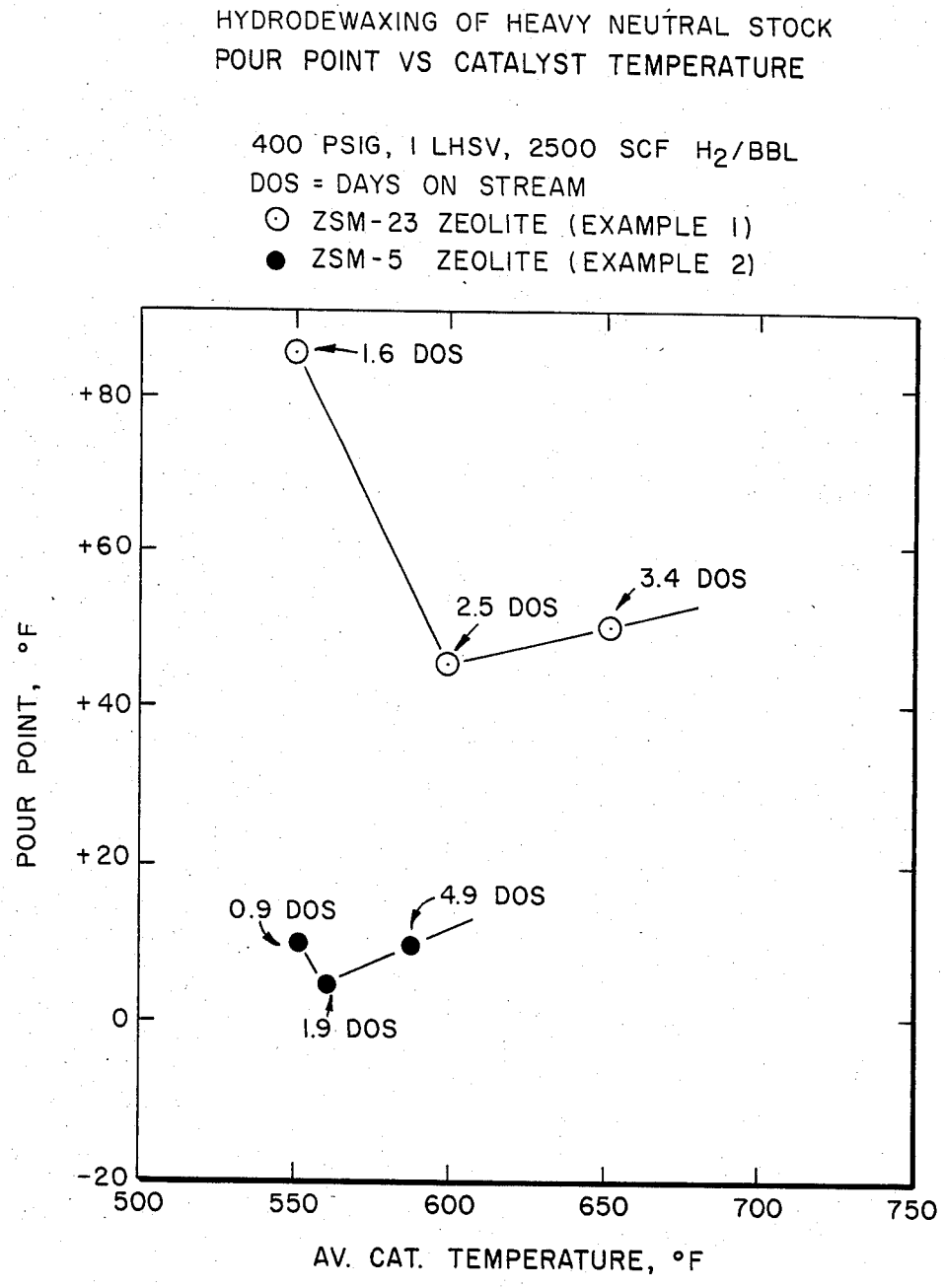
FIG. 2 is a graphical representation of the dewaxing experiments data of Examples 1 and 2.
Figure 3:
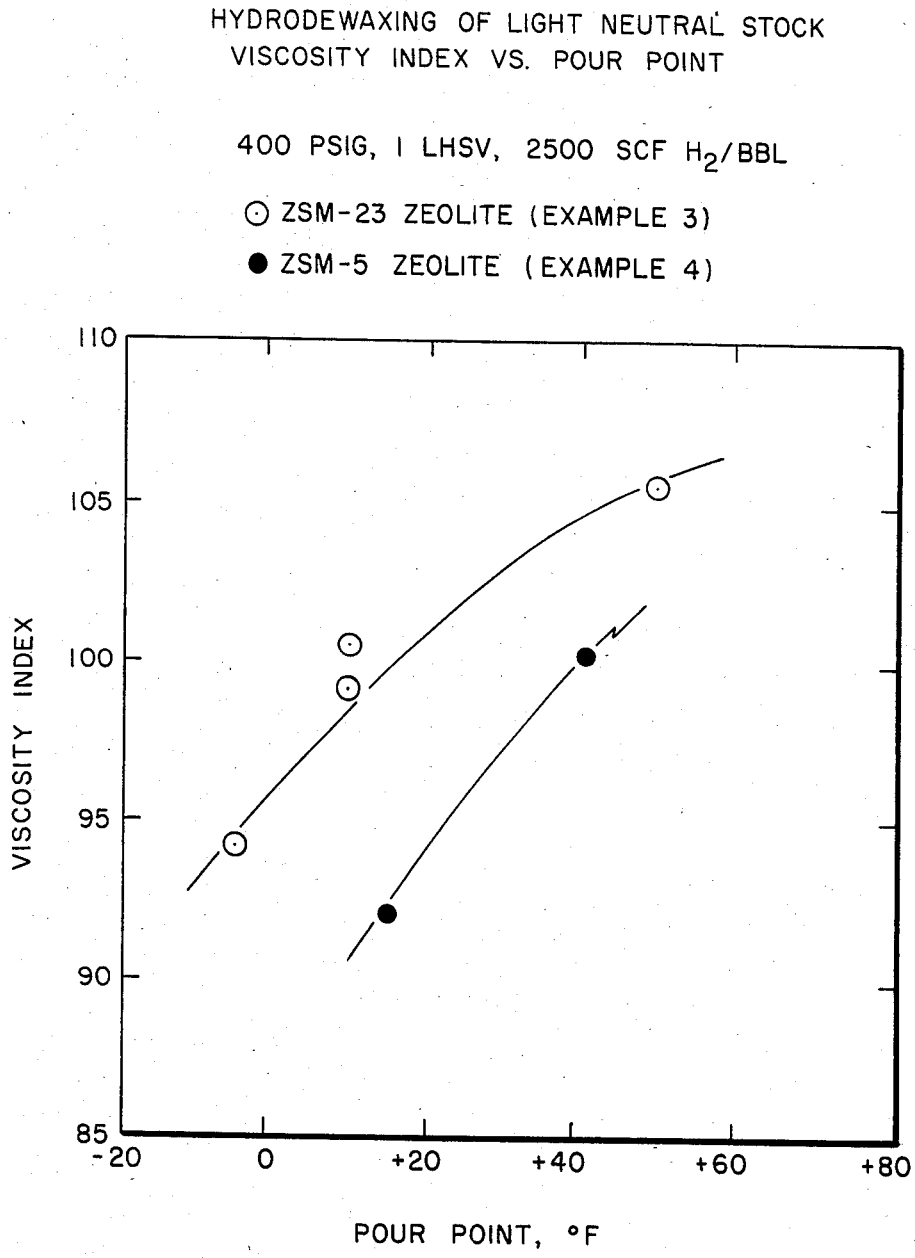
FIG. 3 is a graphical representation of the dewaxing experiments data of Examples 3 and 4.

FIGS. 2 and 3 graphically illustrate the results of the dewaxing experiments of Examples 1–4.

As illustrated in Examples 1–4, zeolites having pore openings defined by: (1) ratio of sorption of n-hexane to o-xylene of greater than about 3, and (2) the ratio $k_{3MP}/k_{DMB}$ of greater than about 2, such as zeolite ZSM-23, are surprisingly more selective than zeolites of the second types, such as ZSM-5, for hydrodewaxing light neutral and lower molecular weight waxy lube stocks, giving a higher yield of a higher viscosity index lube oil (FIG. 3). The activity of such zeolites, however, is insufficient to dewax heavy neutral and higher molecular weight chargestocks to reach target pour points of about 10°–20° F. under standard catalytic lube dewaxing conditions (FIG. 2).

In contrast, zeolites of the second type, having pore openings defined by: (1) a ratio of sorption of n-hexane to o-xylene of less than about 3; (2) the ratio of $k_{3MP}/k_{DMB}$ of less than about 2; and (3) Constraint Index of greater than about 1, such as ZSM-5 zeolite, are surprisingly more selective when they are used to dewax the heavier chargestocks than the lighter chargestocks, as measured by yield and viscosity index (FIG. 2). The present process takes advantage of the unexpected selectivity differences of these two types of zeolites by providing two separate reactors for catalytically dewaxing relatively light and relatively heavy chargestocks, respectively.

It will be apparent to those skilled in the art that the specific embodiments discussed above can be successfully repeated with ingredients equivalent to those generically or specifically set forth above and under variable process conditions.

From the foregoing specification, one skilled in the art can readily ascertain the essential features of this invention and without departing from the spirit and scope thereof can adapt it to various diverse applications.

What is claimed is:

1. An integrated process for catalytically dewaxing a relatively light petroleum chargestock, characterized by a 50% boiling point of less than about 850° F. and a kinematic viscosity at 100° C. of less than about 9 centistokes, and a relatively heavy petroleum chargestock, characterized by a 50% boiling point of greater than about 850° F. and kinematic viscosity at 100° C. of greater than about 9 centistokes comprising:

contacting the relatively light petroleum chargestock in a first dewaxing reactor with a dewaxing catalyst of a crystalline zeolite having pore openings defined by: (1) a ratio of sorption of n-hexane to o-xylene, on a volume percent basis, of greater than about 3, which sorption is determined at a $P/P_o$ of 0.1 and at a temperature of 50° C. for n-hexane and 80° C. for o-xylene and (2) by the ability of selectively cracking 3-methylpentane (3MP) in preference to the doubly branched 2,3-dimethylbutane (DMB) at 1000° F. and 1 atmosphere pressure from a 1/1/1 weight ratio mixture of n-hexane/3-methyl-pentane/2,3-dimethylbutane, with the ratio of rate constants $k_{3MP}/k_{DMB}$ determined at a temperature of 1000° F. being in excess of about 2 to produce a catalytically dewaxed light stock, contacting the relatively heavy petroleum chargestock in a second dewaxing reactor with a dewaxing catalyst of a crystalline zeolite having pore openings defined by: (1) a ratio of sorption of n-hexane to o-xylene, on a volume percent basis, of less than about 3, which sorption is determined at a $P/P_o$ of 0.1 and at a temperature of 50° C. for n-hexane and 80° C. for o-xylene, (2) by the ability of selectively cracking 3-methylpentane (3MP) in preference to the doubly branched 2,3-dimethylbutane (DMB) at 1000° F. and 1 atmosphere pressure from a 1/1/1 weight ratio mixture of n-hexane/3-methyl-pentane/2,3-dimethylbutane, with the ratio of rate constants $k_{3MP}/k_{DMB}$ determined at a temperature of 1000° F. being less than about 2, and (3) a Constraint Index value of greater than about 1, to produce a catalytically dewaxed heavy stock, and subsequently hydrotreating the effluent from said first and second dewaxing reactors in a downstream hydrotreating reactor.

2. The process of claim 1 wherein the zeolite in the first dewaxing reactor is selected from the group consisting of natural and synthetic ferrierites, ZSM-22, ZSM-23, ZSM-35 and mixtures thereof.

3. The process of claim 1 wherein the zeolite in the second dewaxing reactor is selected from the group consisting of ZSM-5, ZSM-11, ZSM-5/ZSM-11 intermediate and mixtures thereof.

4. The process of claim 1 wherein both dewaxing reactors operate simultaneously, and wherein the catalytically dewaxed light and heavy stocks are comingled and continuously charged to the hydrotreating reactor.

5. The process of claim 1 wherein only one dewaxing reactor is in service at any time.

6. The process of claim 1 wherein the dewaxing reactors operate at conditions including a temperature of from about 400° F. to about 900° F., a pressure of from about 50 to about 3000 psig and a liquid hourly space velocity of from about 0.1 to about 10.

7. The process of claim 1 wherein the dewaxing reactors operate at conditions including a temperature of from about 550° F. to about 750° F., a pressure of from about 500 to about 1500 psig and a liquid hourly space velocity of from about 0.5 to about 2.

8. The process of claim 1 wherein the hydrotreating reactor operates at conditions including a temperature of from about 400° F. to about 600° F., a pressure of from about 50 to about 3000 psig and a liquid hourly space velocity of from about 0.1 to about 10, and a hydrogen circulation rate of from about 500 to about 10,000 standard cubic feet per barrel of feed.

9. The process of claim 6 wherein the dewaxing reactors operate at a hydrogen circulation rate of from about 500 to about 10,000 standard cubic feet per barrel of feed.

10. The process of claim 7 wherein the dewaxing reactors operate at a hydrogen circulation rate of from about 1,000 to about 5,000 standard cubic feet per barrel of feed.

11. The process of claim 1 wherein the dewaxing catalysts contain a metal hydrogenation component.

12. The process of claim 2 wherein the dewaxing catalysts contain a metal hydrogenation component.

13. The process of claim 3 wherein the dewaxing catalysts contain a metal hydrogenation component.

14. The process of claim 1 wherein the zeolite in the first dewaxing reactor is ZSM-23 and the zeolite in the second dewaxing reactor is ZSM-5.

15. The process of claim 14 wherein the dewaxing catalysts contain a metal hydrogenation component.

16. The process of claim 15 wherein the metal hydrogenation component is platinum.

* * * * *